US006109515A

United States Patent [19]

Duboff

[11] Patent Number: 6,109,515

[45] Date of Patent: Aug. 29, 2000

[54] SEALABLE CONTAINER ASSEMBLY

[76] Inventor: Gary Duboff, 1271 - 101st St., Bay Harbor Islands, Fla. 33154

[21] Appl. No.: 09/089,996

[22] Filed: Jun. 3, 1998

[51] Int. Cl.[7] ..... B65D 5/64; B65D 43/00

[52] U.S. Cl. ..... 229/125.33; 220/359.1; 220/359.2; 220/612; 220/613; 220/617; 220/621; 220/783; 229/5.5; 229/125.35; 229/404

[58] Field of Search ..... 229/103.3, 123.2, 229/125.29, 125.32, 125.33, 125.34, 125.35, 404, 5.5; 220/4.23, 359.1, 359.2, 612, 613, 617, 621, 780, 783; 206/813; 156/69; 428/41.7

[56] References Cited

U.S. PATENT DOCUMENTS

| | | | |
|---|---|---|---|
| 2,828,789 | 4/1958 | Groendyk et al. | 220/783 |
| 3,108,710 | 10/1963 | Lange et al. | 220/613 |
| 3,192,091 | 6/1965 | Hey et al. | 229/125.35 |
| 3,650,386 | 3/1972 | Tigner . | |
| 3,757,388 | 9/1973 | Wolny | 220/4.23 |
| 4,044,941 | 8/1977 | Knudsen . | |
| 4,165,011 | 8/1979 | Holk, Jr. | 220/359.1 |
| 4,215,797 | 8/1980 | Chen . | |
| 4,268,336 | 5/1981 | Piltz et al. | 220/613 |
| 4,397,404 | 8/1983 | Blanchette | 220/783 |
| 4,750,609 | 6/1988 | Felis | 229/103.3 |
| 4,938,390 | 7/1990 | Markva | 156/69 |
| 5,036,994 | 8/1991 | McElroy . | |
| 5,145,079 | 9/1992 | Woodrow et al. . | |
| 5,236,120 | 8/1993 | Kleemola | 229/5.5 |
| 5,259,503 | 11/1993 | Steingraber, Jr. | 220/612 |
| 5,427,266 | 6/1995 | Yun | 220/780 |
| 5,499,713 | 3/1996 | Huffer | 206/813 |
| 5,722,554 | 3/1998 | Chanal et al. | 220/780 |

*Primary Examiner*—Gary E. Elkins
*Attorney, Agent, or Firm*—Wallenstein & Wagner, Ltd.

[57] ABSTRACT

The present invention relates to a disposable lid sealed to a disposable container using an adhesive. The present invention also relates to an improved disposable assembly. The assembly has a container and a lid. The container includes a rim and a tongue extending from the rim, and the lid includes a cover and a groove along the peripheral edge of the cover shaped to correspond with the tongue of the container.

13 Claims, 4 Drawing Sheets

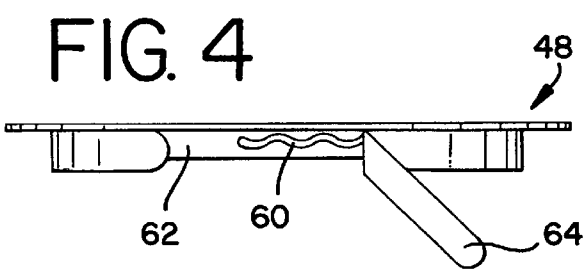
FIG. 4
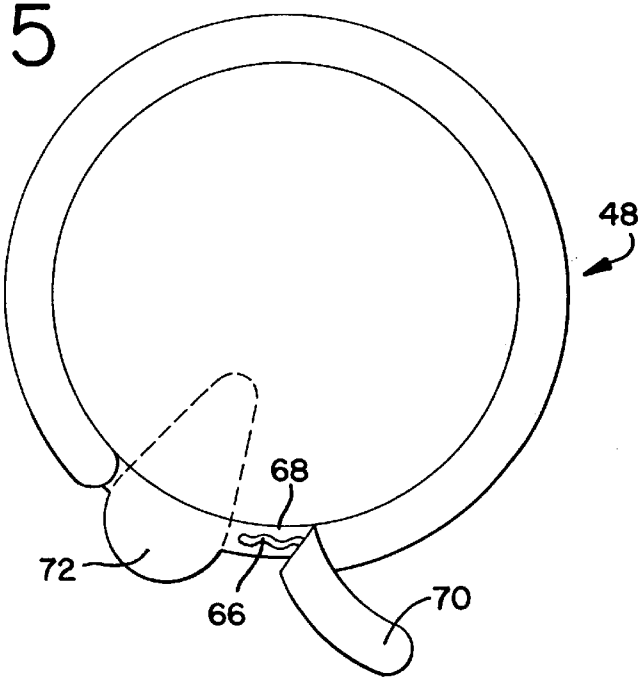
FIG. 5
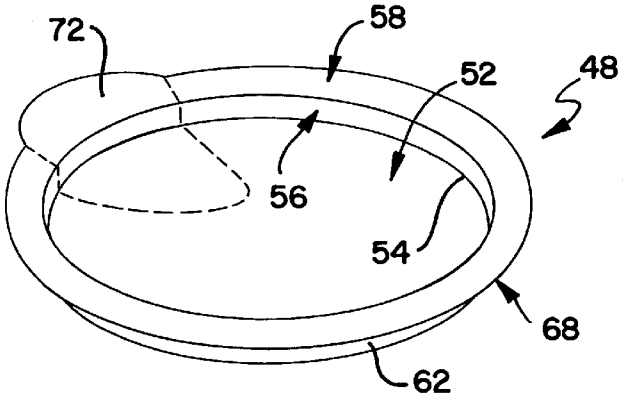
FIG. 3
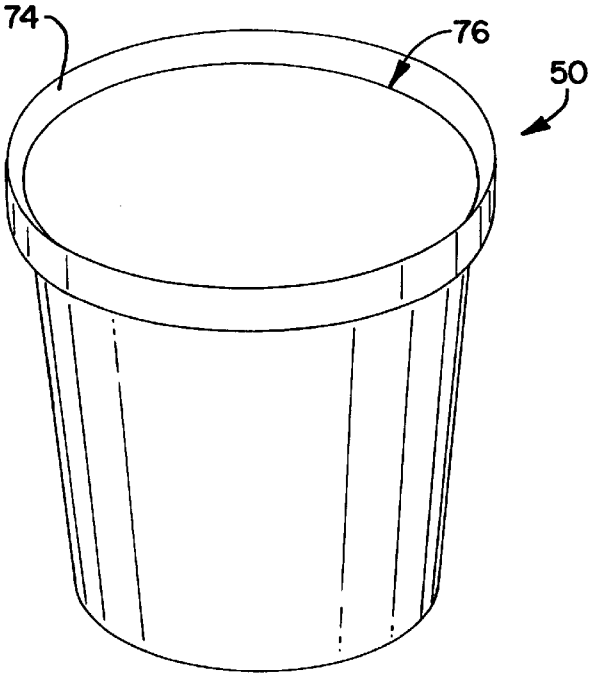

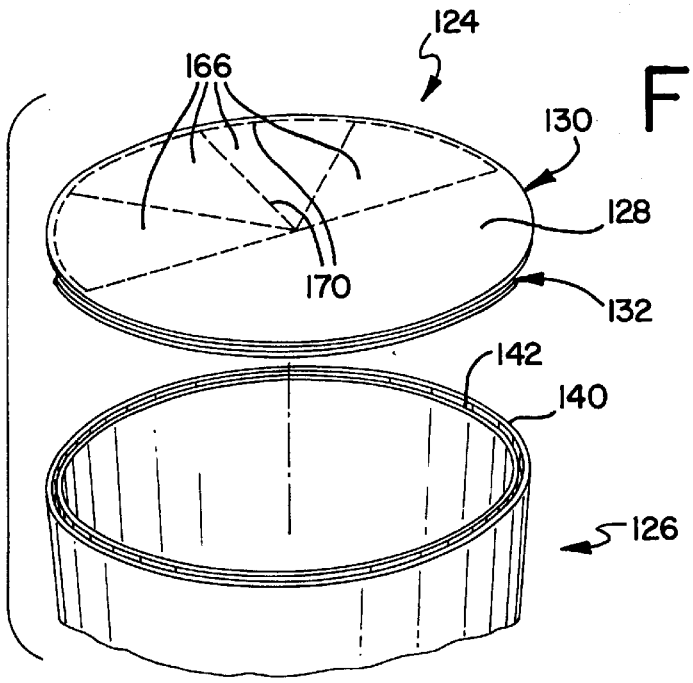
FIG. 8
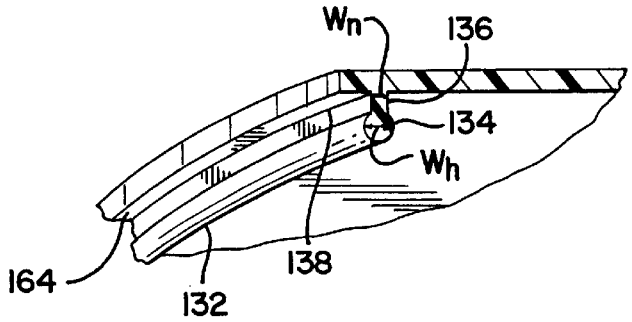
FIG. 9
FIG. 10
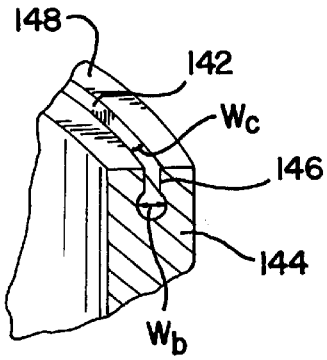
FIG. 11
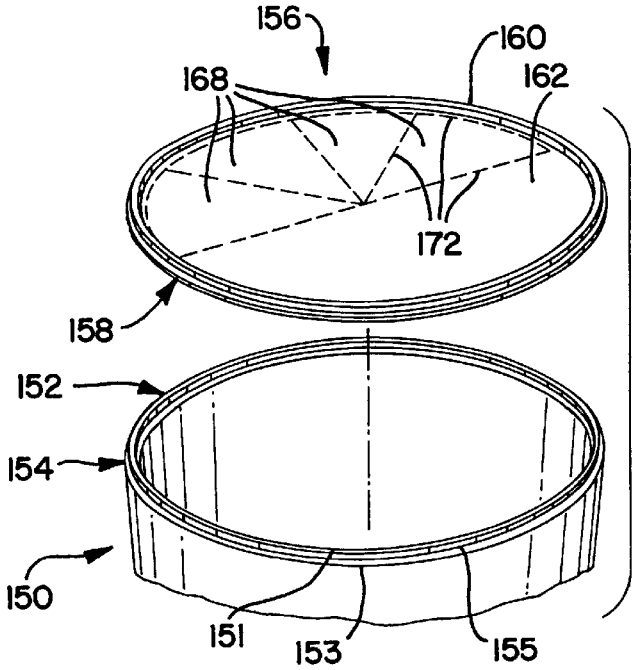

SEALABLE CONTAINER ASSEMBLY

BACKGROUND OF THE INVENTION

Conventional disposable container assemblies comprise a disposable lid frictionally engaged to a disposable container. Under normal circumstances, the conventional assemblies protect the contents of the container and prevent the contents from spilling upon agitation. These containers, however, do not protect the contents if the container is dropped.

SUMMARY OF THE INVENTION

The present invention relates to a container assembly using an adhesive to hold a lid onto a container. Specifically, an adhesive with a removable strip is placed along the periphery of the container or the lid, either on the inner or the outer surface. The strip is removed to expose the adhesive when placing the lid onto the container. The container assembly of the present invention prevents the lid from dislodging from the container if the assembly is dropped.

The present invention also relates to an improved assembly having a container and a lid. The lid has a cover with a peripheral edge and a tongue extending transversely from the cover adjacent the peripheral edge. The container has a rim and a groove in the rim shaped to correspond with the tongue of the lid.

In an alternate embodiment of the improved assembly, the container has a rim and a tongue extending from the rim. The lid has a cover and a groove along the peripheral edge of the cover shaped to correspond with the tongue of the container.

Other advantages and aspects of the present invention will become apparent upon reading the following description of the drawings and detailed description of the invention.

BRIEF DESCRIPTION OF THE DRAWINGS

FIG. 3 is a perspective view of a third embodiment of a disposable lid and container in accordance with the present invention;

FIG. 4 is a side view of the disposable lid of FIG. 3;

FIG. 5 is a bottom view of a second embodiment of the disposable lid of FIG. 3;

FIG. 8 is a perspective view of a disposable lid and container in accordance with the present invention;

FIG. 9 is an exploded cross-sectional view of the peripheral edge of the disposable lid of FIG. 8;

FIG. 10 is an exploded cross-sectional view of the rim of the disposable container of FIG. 8; and FIG. 11 is a perspective view of a disposable lid and container in accordance with the present invention.

DETAILED DESCRIPTION

Figure 2:
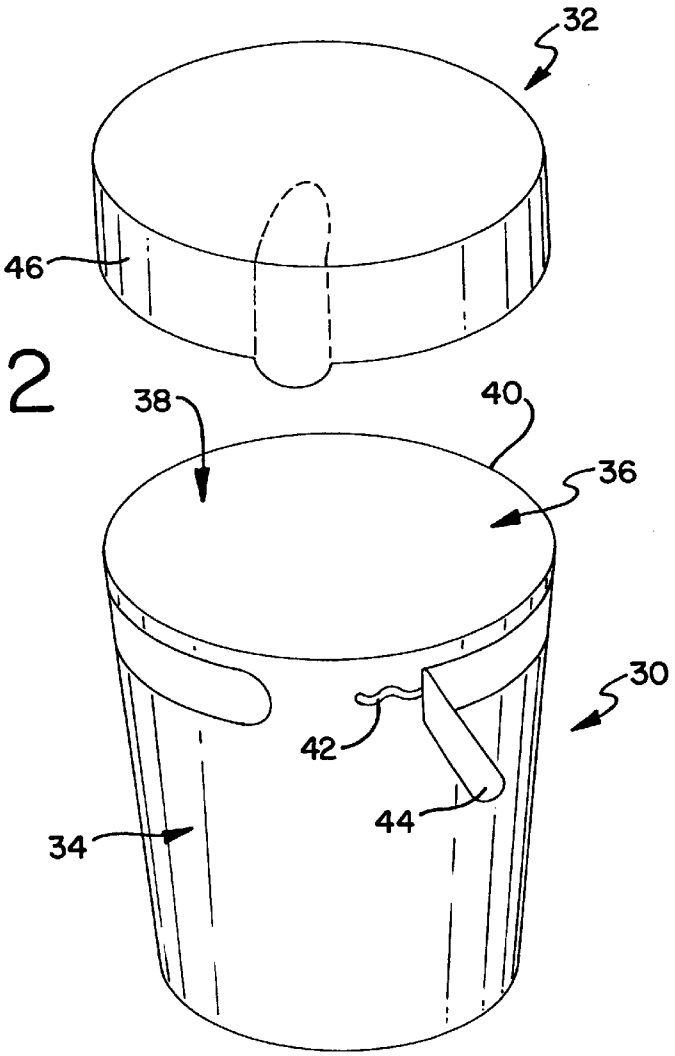
FIG. 2 is a perspective view of a second embodiment of a disposable lid and container in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
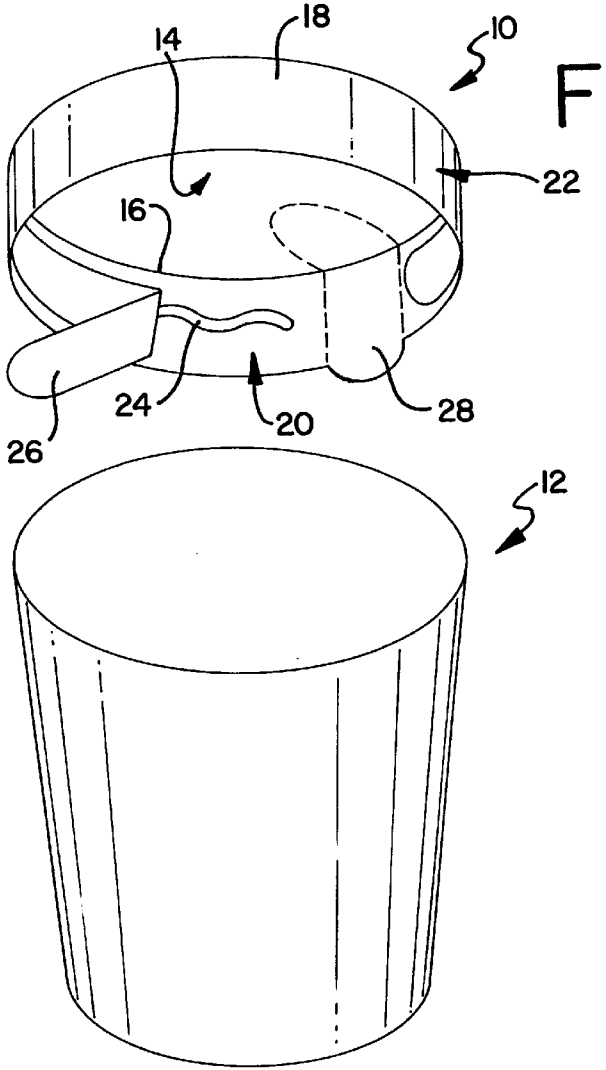
FIG. 1 is a perspective view of a disposable lid and container in accordance with the present invention.

A disposable lid 10 in accordance with the present invention is shown in FIG. 1 along with its corresponding container 12. The lid 10 has a cover 14 with a peripheral edge 16. The lid 10 also has a skirt 18 extending transversely from the cover 14 along the peripheral edge 16. The skirt 18 has an inner surface 20 and an outer surface 22. An adhesive 24 is placed on the inner surface 20 of the skirt 18, and a removable strip 26 is placed over the adhesive 24. The lid 10 has a tab 28 along the cover 14 of the lid 10 which may be removed to access the contents of the container.

Another embodiment of a disposable container 30 of the present invention is shown in FIG. 2 along with its corresponding lid 32. The container 30 has an outer surface 34, an inner surface 36 and an opening 38 with a rim 40. An adhesive 42 is placed on the outer surface 34 of the container 30 adjacent the rim 40, and a removable strip 44 is placed over the adhesive 42.

To seal the container 12, 30 with the lid 10, 32, the strip 26,44 overlaying the adhesive 24, 42 is removed, and the lid 10, 32 is frictionally engaged onto the container 12, 30 so that the adhesive 24, 42 lies between the skirt 18, 46 of the lid 10, 32 and the container 12, 30.

FIGS. 1 and 2 illustrate a container assembly where the inner surface 20 of the skirt 18, 46 of the lid 10, 32 grips the outer wall 34 of the container 12, 30 in a sealed position. In an alternate embodiment, the lid may fit within the opening of the container, and may grip the inner wall of the container, as shown in FIGS. 3–6.

FIG. 3 illustrates a disposable lid 48 with its corresponding container 50. The lid 48 has a cover 52 with a peripheral edge 54, and a skirt 56 extending transversely from the cover 52 along the peripheral edge 54. The lid 48 also has a lip 58 extending transversely from the skirt 56. An adhesive 60 is placed on the outer surface 62 of the skirt 56 and a removable strip 64 is placed over the adhesive 60, as shown in FIG. 4. Alternatively, an adhesive 66 is placed on the lower surface 68 of the lip 58, and a removable strip 70 is placed over the adhesive 66, as shown in FIG. 5. The lid 48 has a tab 72 along the cover 52 of the lid 48 which may be removed to access the contents of the container 50. The container 50 may be provided with a lip 74 adjacent the rim 76 on which the adhesive 60, 66 from the lid 48 may attach.

Figure 6:
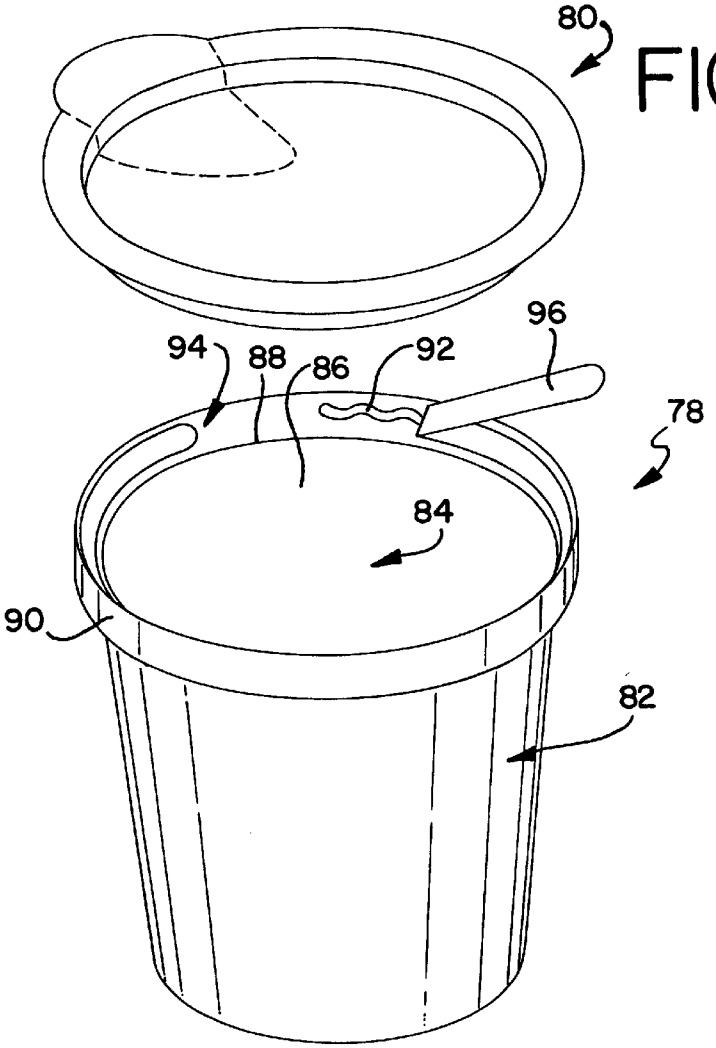
FIG. 6 is a perspective view of a fourth embodiment of a disposable container and lid in accordance with the present invention.

Another embodiment of a disposable container 78 of the present invention is shown in FIG. 6 along with its corresponding lid 80. The container 78 has an outer surface 82, an inner surface 84 and an opening 86 with a rim 88. The container 78 has a lip 90 adjacent the rim 88. An adhesive 92 is placed on the inner surface 94 of the lip 90 of the container 78. If container 78 is not provided with lip 90, adhesive 92 is placed on the inner surface 84 of the container 78. (Not shown.) A removable strip 96 is placed over the adhesive 92.

Figure 7:
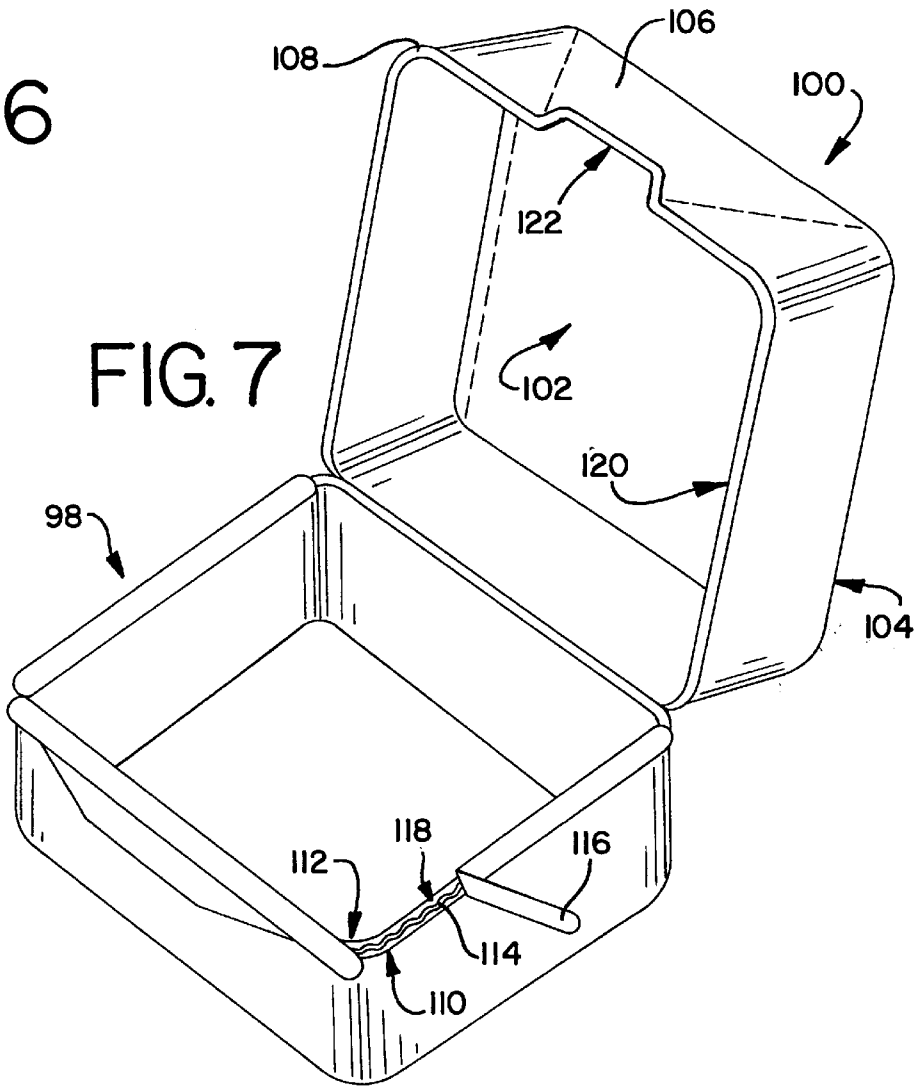
FIG. 7 is a perspective view of a fifth embodiment of a disposable container and lid in accordance with the present invention.

Although the containers shown in FIGS. 1–6 have a cylindrical configuration, the container may assume a variety of shapes, e.g., a cube, a rectangular or triangular box, etc. For example, FIG. 7 depicts a disposable container 98 and an adjoining lid 100 in accordance with the present invention. The lid 100 has a cover 102 with a peripheral edge 104, a skirt 106 extending transversely from the cover 102 along the peripheral edge 104 and a lip 108 extending transversely from the skirt 106. The container 98 has a lip 110 adjacent the rim 112. An adhesive 114 with a removable strip 116 is placed on the inner surface 118 of the lip 110 of the container 98, as shown in FIG. 7. In the alternative, the adhesive and removable strip are placed on the lower surface 120 of the lip 108 on the lid 100. (Not shown). The lid 100 has a tab 122 along the cover 102 of the lid 100 which may be removed to access the contents of the container 98.

In another embodiment of the present invention, a disposable lid 124 in accordance with the present invention is shown in FIG. 8 along with its corresponding container 126. The lid 124 has a cover 128 with a peripheral edge 130. The lid 124 also has a tongue 132 extending transversely from the cover 128 adjacent the peripheral edge 130. The tongue 132 has a head 134, a neck 136 and a shoulder 138, as shown in FIG. 9. The width $w_n$ of the neck 136 is smaller than the width $w_h$ of the head 134.

The rim 140 of the container 126 includes a groove 142. The groove 142 has a rounded base 144, and a column 146 having a width $w_c$ smaller than the width $w_b$ of the base 144, as shown in FIG. 10. In addition, the width $w_c$ of the column is smaller than the width $w_h$ of the head 134. The container also has a ridge 148. Thus, the groove 142 is shaped to correspond with the tongue 132 of the lid 124.

To seal the lid 124 onto the container 126, the tongue 132 is snapped into the groove 142 so that the shoulder 138 rests on the ridge 148. Because the width $w_h$ of the head 134 is larger than the width $w_c$ of the column 146, the head 134 locks into the base 144 of the groove 142. Alternatively, the disposable container 150 has a tongue 152 extending from the rim 154 of the container 150, and the disposable lid 156 has a groove 158 along the peripheral edge 160 of the cover 162 shaped to correspond with the tongue 152 of the container 150, as shown in FIG. 11. The tongue 152 of the container 150 has a head 151, neck 153 and shoulder 155.

An adhesive 164 may be placed on the shoulder 138, 155 to seal the lid 124, 156 onto the container 126, 150, as shown in FIG. 9. In the preferred embodiment, a removable strip (not shown) is placed over the adhesive 164. In addition, the lid 124, 156 has tabs 166, 168 along the cover 128, 162 of the lid 124, 156 defined by perforations 170, 172. The perforations 170, 172 extend up to and along the peripheral edge 130, 160 of the lid. The tabs 166, 168 are removable to access the contents of the containers 126, 150.

While specific embodiments have been illustrated and described, numerous modifications come to mind without significantly departing from the spirit of the invention and the scope of protection is only limited by the scope of the accompanying Claims.

I claim:

1. In a lid having a cover with a peripheral edge, and a skirt extending transversely from the cover along the peripheral edge, the skirt having an inner surface and an outer surface, the improvement comprising:

an adhesive on one of said surfaces of said skirt; and a removable strip overlaying said adhesive.

2. The lid of claim 1 wherein said adhesive is on the inner surface of the skirt.

3. The lid of claim 1 wherein said adhesive is on the outer surface of the skirt.

4. The lid of claim 1 further comprising a removable tab.

5. The lid of claim 1 further comprising a cylindrical shape.

6. The lid of claim 1 further comprising a square shape.

7. The lid of claim 1 further comprising a lip extending transversely from the skirt.

8. In a lid having a cover with a peripheral edge, a skirt extending transversely from the cover along the peripheral edge, and a lip having a lower surface wherein said lip extends transversely from the skirt, the improvement comprising:

an adhesive on the lower surface of the lip; and a removable strip overlaying said adhesive.

9. The lid of claim 8 further comprising a removable tab.

10. The lid of claim 8 further comprising a cylindrical shape.

11. The lid of claim 8 further comprising a square shape.

12. An assembly having a container and a lid, wherein:

(a) the lid comprises a cover with a peripheral edge, and a tongue extending transversely from the cover adjacent the peripheral edge, the tongue including
  (i) a head with a width;
  (ii) a neck adjacent the head, the neck having a width smaller than the width of the head; and
  (iii) a shoulder, the shoulder having an adhesive, with a removable strip overlaying the adhesive; and wherein (b) the container comprises a rim, and a groove in the rim shaped to correspond with the tongue of the lid.

13. An assembly having a container and a lid, wherein (a) the container comprises a rim; and a tongue extending from the rim, the tongue having:
  (i) a head with a width;
  (ii) a neck adjacent the head, the neck having a width smaller than the width of the head; and
  (iii) a shoulder, the shoulder having an adhesive, with a removable strip overlaying the adhesive; and wherein (b) the lid comprises a cover, and the cover having a peripheral edge, and wherein the lid further comprises a groove along the peripheral edge of the cover, shaped to correspond with the tongue of the container.

* * * * *